US005603551A

United States Patent [19]

Sheehan

[11] Patent Number: 5,603,551

[45] Date of Patent: Feb. 18, 1997

[54] GRAVITATIONAL RESISTANT POSITIONAL CHAIR

[76] Inventor: Kelly Sheehan, 2951 Washata Bay Rd., Excelsior, Minn. 55337

[21] Appl. No.: 586,579

[22] Filed: Jan. 16, 1996

[51] Int. Cl.[6] ..... A47C 1/023; A47C 1/024; B60N 2/12

[52] U.S. Cl. ..... 297/329; 297/261.3; 297/216.19; 297/318; 297/322; 297/344.1

[58] Field of Search ..... 297/329, 318, 297/322, 317, 344.1, 302.1, 302.2, 261.2, 261.3, 216.19

[56] References Cited

U.S. PATENT DOCUMENTS

| | | | |
|---|---|---|---|
| 2,100,170 | 11/1937 | Parks | 297/329 |
| 2,137,923 | 11/1938 | Olschlager et al. | 297/329 |
| 2,516,172 | 7/1950 | Maurer | 297/329 |
| 2,598,384 | 5/1952 | Huber | 297/329 |
| 4,383,714 | 5/1983 | Ishida | 297/261.3 |
| 4,640,548 | 3/1987 | Desanta . | |
| 4,650,249 | 3/1987 | Serber . | |
| 4,676,553 | 6/1987 | Lange . | |
| 4,682,814 | 7/1987 | Hansen . | |
| 4,786,105 | 11/1988 | Sheehan et al. . | |
| 5,449,218 | 9/1995 | Beavais et al. | 297/329 |

*Primary Examiner*—Peter R. Brown
*Assistant Examiner*—Anthony D. Barfield
*Attorney, Agent, or Firm*—Leo Gregory

[57] ABSTRACT

A desk chair particularly designed to have supporting members disposed between guide members having facing complementary grooves, and the supporting members having supporting rollers riding in said grooves whereby the chair responds to movement of the body to retain it in a good posture position, the only force present in said structure being that of gravity.

3 Claims, 3 Drawing Sheets

GRAVITATIONAL RESISTANT POSITIONAL CHAIR

BACKGROUND OF THE INVENTION

1. Field of the Invention

This invention is in the field of office desk chairs.

2. Description of the Prior Art

In general office or desk chairs are adapted to have the seat portion or back rest portion incline with the motion of the user and a restoring force is present to return the seat or back rest to an upright position.

The posture of the user while seated affects significantly the effort of the user in performing his work. Although it may only be desk work, unnatural or strained positions of the user are tiring and adversely affect both the mental and physical exertion of effort.

Some chairs are adapted for the particular weight of a user with regard to the force required to incline the seat and/or back rest by a shift of body weight and a corresponding restoring force is generally present.

Several patents as provided without analysis to indicate the state of the art.

SUMMARY OF THE INVENTION

The particular object of the invention herein is to provide a desk chair which will support correct posture and lessen the presence of fatigue.

It is another object herein to provide a desk chair specifically designed to reduce discal pressure and correspondingly reduce spinal stress.

More generally it is an object herein to do more than just provide an adjustable desk chair but to provide a chair with the special purpose of accomodating the natural motion of a body in using a chair in the various movements that a body goes through in working at a desk.

These and other objects and advantages of the invention will be set forth in the following description made in connection with the accompanying drawings in which like reference characters refer to similar parts throughout the several views.

DESCRIPTION OF A PREFERRED EMBODIMENT

Figures 1, 2, 3:
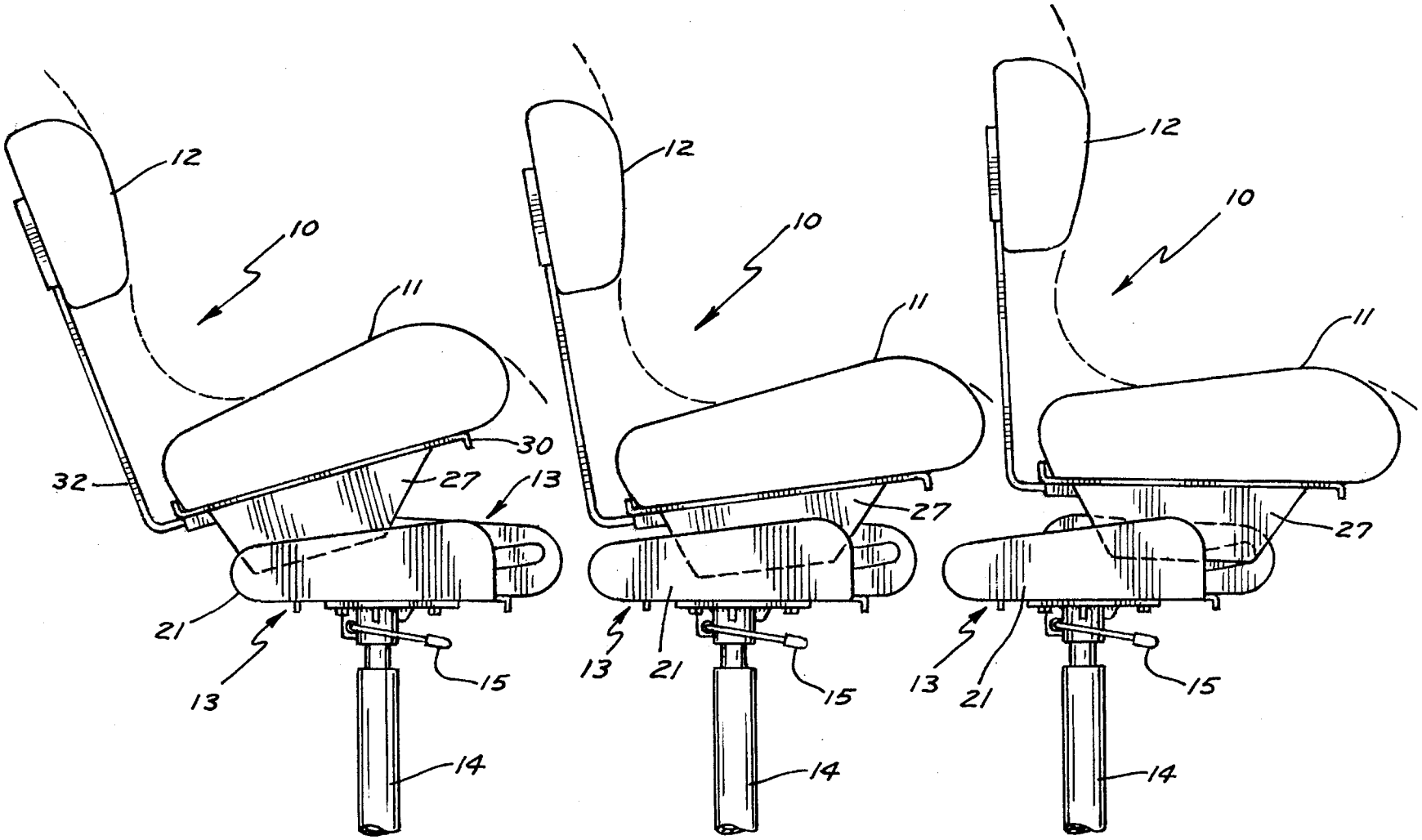
FIG. 1 is a side elevational view of one position of the invention with a portion broken away.
FIG. 2 is a view similar to that of FIG. 1 showing another position.
FIG. 3 is a view similar to that of FIGS. 1 and 2 showing another position.

Referring to the drawings and more particularly to FIGS. 1–3, shown is an office type of desk chair 10 comprising a seat 11, a back rest 12, a seat supporting structure 13 and a conventional support column 14 underlying which and supporting said column is a conventional leg assembly support and is not here shown. Covered on said column is a lever arm 15 which with conventional structure, not shown, is operated to elevate or lower said seat relative to said column.

Said seat and back rest are integral and have unitary movement. The principal novelty of the invention herein is in the makeup of the support structure 13 as is shown in FIGS. 4–8 and as will be described.

Said support structure 13 comprises a bottom plate member 16 which is carried on a central plate member 17 supported on a collar 18 secured to the upper portion of said column 14. Said plate member has a front end 16*a* and a rear end 16*b*.

Said plate member 16 is substantially square in plan and has secured thereon at opposed sides thereof stationary guide members 21 and 22 and spaced inwardly thereof respectively are inner stationary guide members 23 and 24.

Said inward guide members 23 and 24 extend to the front end portion 16*a* of said plate members 16 and are forward of the rear end of said plate member. Said outward guide members 21 and 22 are somewhat short of extending to the front end of said plate member and extend to the rear end thereof.

Figure 5:
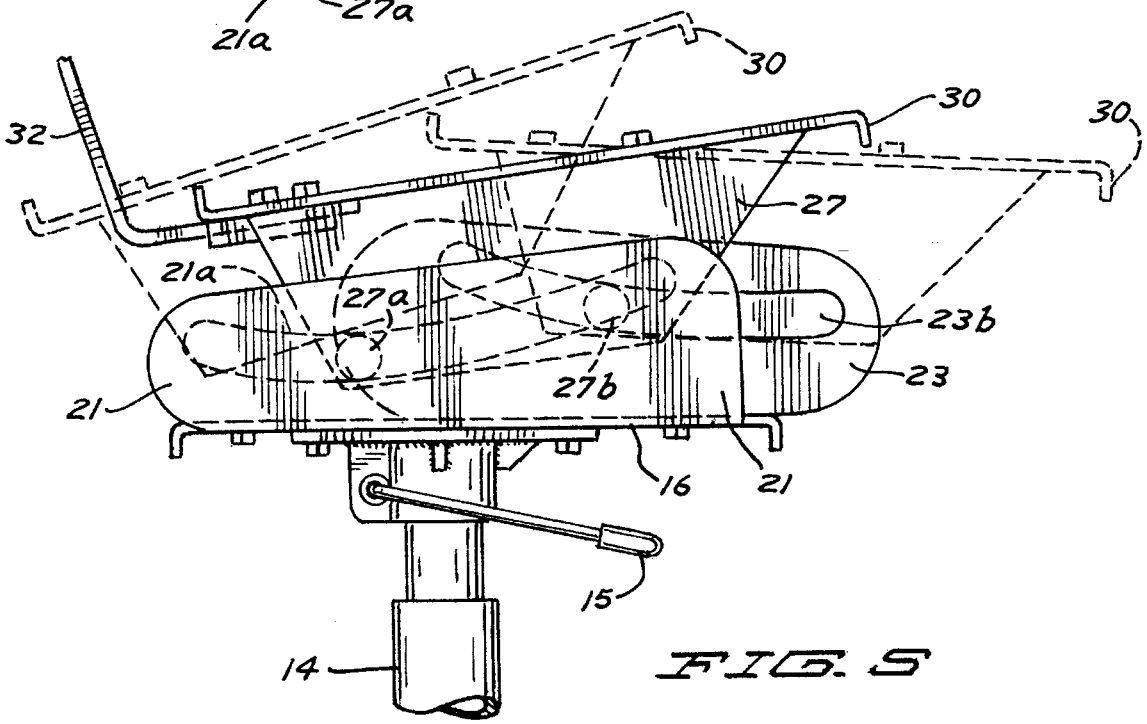
FIG. 5 is a side elevational view of the seat supporting structure showing alternate positions in dotted line.
Figure 6:
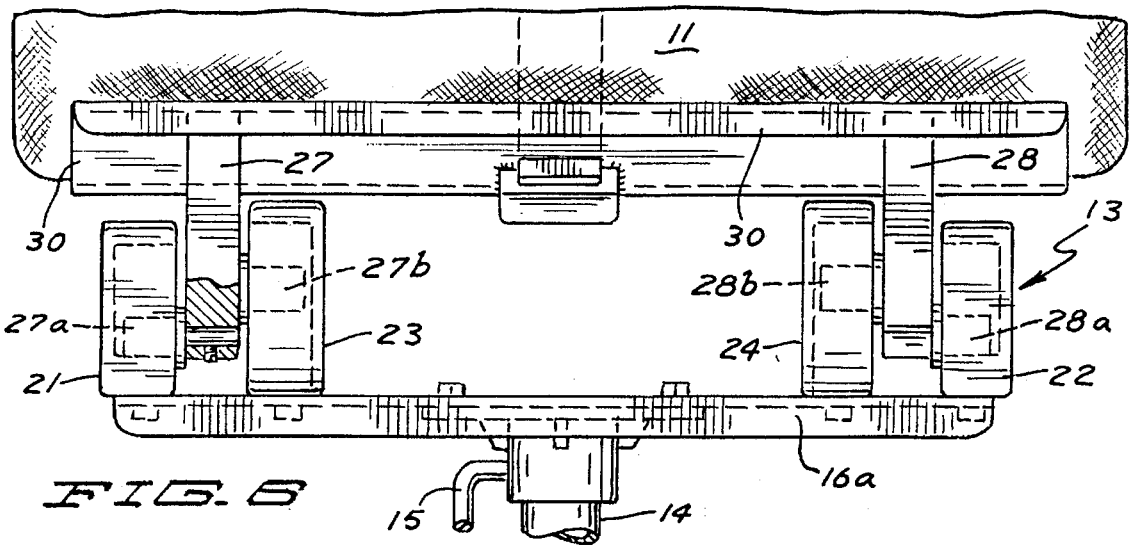
FIG. 6 is a broken view in front elevation of the seat supporting structure.
Figure 7:
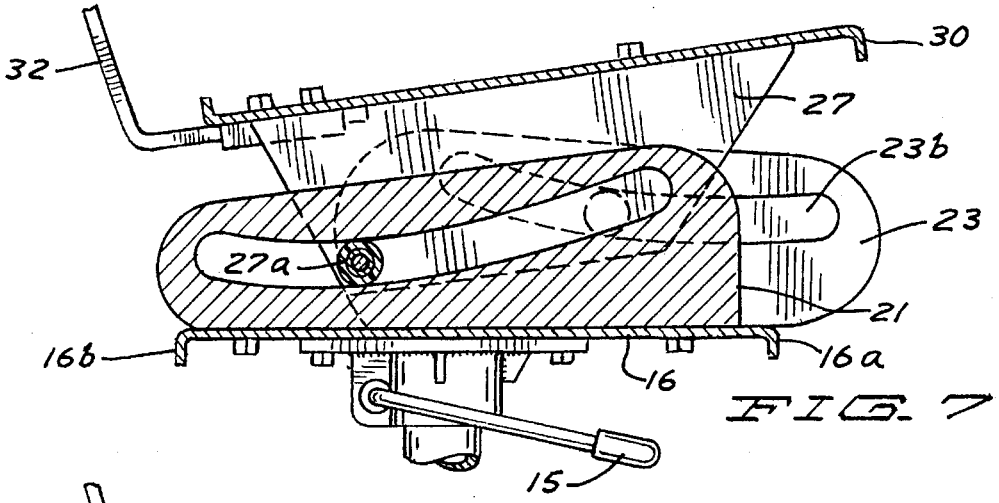
FIG. 7 is a broken view in sections taken in line 7—7 of FIG. 4 as indicated.
Figure 8:
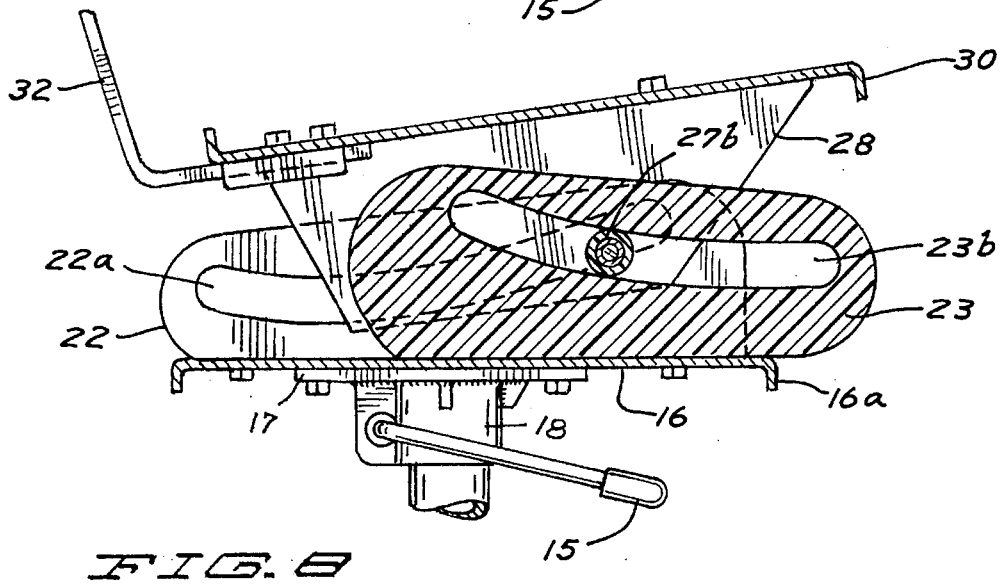
FIG. 8 is a view similar to that of FIG. 7 taken on line 8—8 of FIG. 4 as indicated.

Said members 21 and 22 have opposed elongated arcuate grooves 21*a* and 22*a* recessed within their facing sides with said grooves having a longer upward curvature forwardly of said chair than rearwardly as shown in FIGS. 5, 7 and 8.

The inward guide members 23 and 24 have elongated recessed arcuate grooves 23*a* and 24*a* recessed in their inward sides 23*b* and 24*b* facing and being lesser in length than the recessed grooves 21*a* and 22*a*. It will be noted in FIGS. 5, 7 and 8 that said grooves 23*a* and 24*a* are curved upwardly rearwardly.

Figure 4:
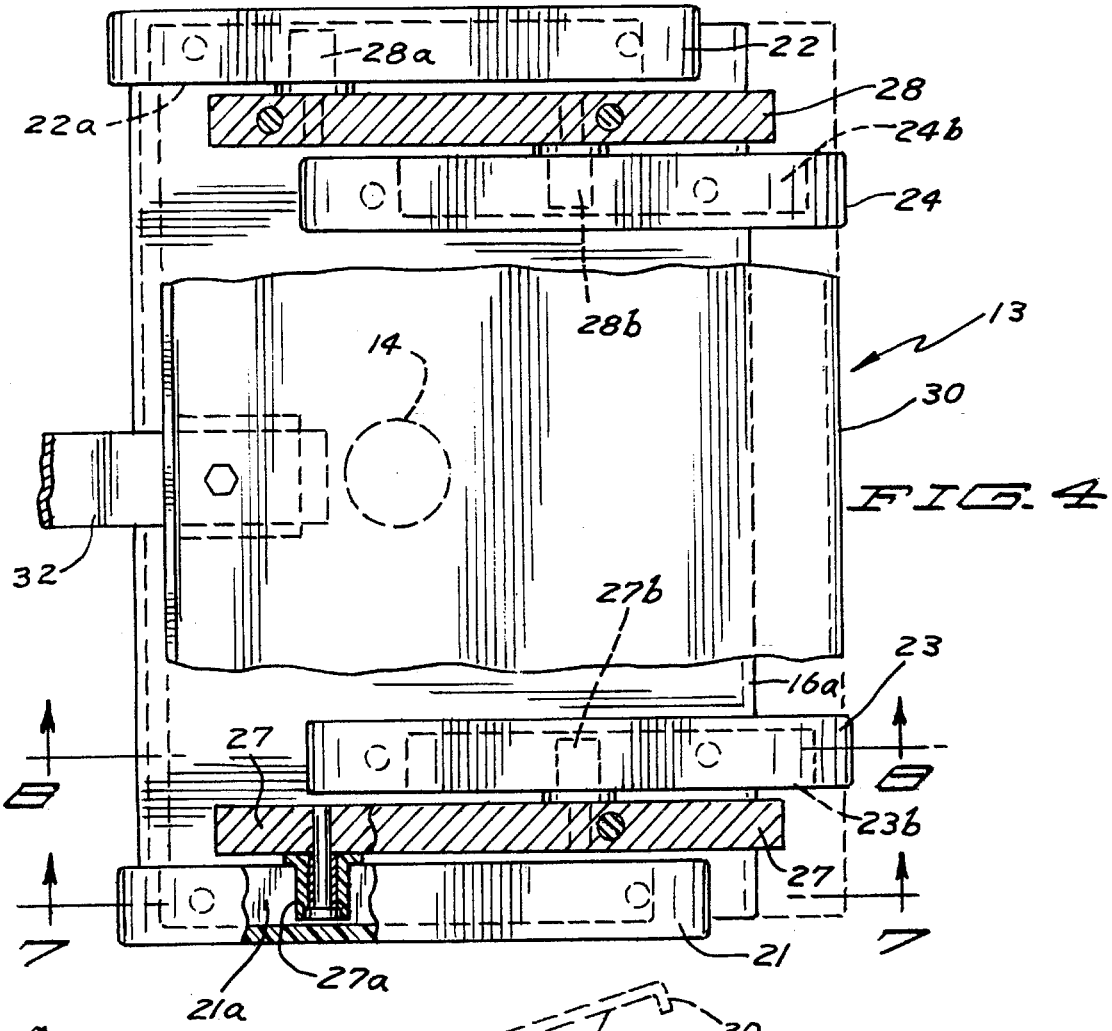
FIG. 4 is a bottom plan view with portions thereof broken away.

Disposed respectively between said members 21–23 and 22–24 are seat support guide members 27 and 28. Spaced inwardly from the ends of said members 27 and 28 to be spaced longitudinally apart and extending outwardly of opposite sides there of are rollers 27*a*–27*b* and 28*a*–28*b* respectively. Said rollers extend into and ride in said grooves 21*a*–23*a* and 22*a*–24*a* as shown in FIGS. 4 and 5.

Overlying said support members 27–28 and secured thereto is a seat supporting plate member 30. Said seat 11 is carried by said plate member 30 and an angled frame member 32 extends upwardly from said plate member 30 to have said back rest 12 secured to the upper portion thereof. As has been indicated, said seat and said back rest are integral.

Said lever arm is operated in a pumping action to adjust the height of said seat 11.

It will be noted that there are no springs to provide a restoring force as is generally the case to return a seat and back rest to an upright position. The seating or sitting position of the chair herein responds entirely to the movement of the users body.

The grooves in the guide members as described and particularly the grooves 21*a*–23*a* and 22*a*–24*a* are particularly designed to complement each other to always have the body of the user in a correct posture position. For example, in FIG. 5 it will be noted that as the rollers 27*a* and 28*a* riding in the grooves 21*a*–22*a* and 23*a*–24*a* as the body is moving to a sitting back position, that the rollers 27*b*–28*b* riding in the grooves 23*a*–24*a* cause the seat 11 to tilt upwardly to naturally position the body of the user in a correct relaxed position and in like manner, when the user moves forwardly to be engaged on his desk, the leading edge portion of the seat will be in a level position while the rear of the seat will be somewhat curved upwardly to support leaning into a desk. In an upright position, the seat is on the level. The movement of the back rest and seat is effortless in responding to the movement of the body. The gravitational hold of the seat and back rest is so minimal that there is no effort required for the body to change positions.

The relative positions of the grooves 21*a*–22*a* and 23*a*–24*a* are unique and represent particular novelty. Coincident with the good posture positions proved by said arrangement there is avoided back or discal pressure from any area of the back as well as stress from the spinal column generally. It is seen that the respected complimentary curvature of the grooves as described are particularly designed to complement one another to achieve the positive results indicated.

It will, of course, be understood that various changes may be made in the form, details and arrangement of the chair structure herein as described and as defined in the appended claims.

What is claimed is:

1. A desk chair structure, comprising a back rest integral with a seat, a pair of laterally spaced slide members supporting said seat, said slide members each being disposed between a pair of closely spaced apart guide members, each pair of said guide members having an arcuate groove in each of the facing sides thereof, said grooves being longitudinally staggered, non-coextensive, non-conforming manner and having laterally spaced overlapping inward end portions, said slide members having means engaged in said grooves and being relatively movable therein, whereby seat movement provides a correct posture position for each body movement of a seated person.

2. The structure of claim 1, wherein said grooves respectively have an increased upward curvature at their said overlapping portions.

3. A desk chair structure, comprising a back rest integral with a seat, an outward and a closely spaced inward guide member underlying each opposed side of said seat comprising first and second pairs of guide members, said inward guide members being positioned relatively forwardly of said seat and said outward guide members being positioned relatively rearwardly of said seat, said outward guide members having corresponding arcuate grooves therein facing their respective inward guide members and having a longer upward curvature forwardly of said seat than rearwardly thereof, said inward guide members having corresponding arcuate grooves therein facing their respective outward guide members and having a longer upward curvature rearwardly of said seat than forwardly thereof, said curvature of said grooves of said outward guide members being longitudinally staggered and non-conforming relative to said grooves of said inward guide members, said curvature of said grooves of said outward and inward pairs of guide members respectively having laterally spaced overlapping inward end portions, seat supporting slide members respectively disposed between the outward and inward guide members of each pair thereof and having engagement with the grooves thereof for relative movement therebetween, whereby said seat moves readily to provide a correct posture position for each body movement of a seated person.

* * * * *